US009216514B2

(12) United States Patent
Bridges et al.

(10) Patent No.: US 9,216,514 B2
(45) Date of Patent: Dec. 22, 2015

(54) MANUALLY ACTUATABLE LIQUID DISPENSING RAZOR

(71) Applicant: The Gillette Company, Boston, MA (US)

(72) Inventors: Kelly Bridges, Quincy, MA (US); Michael H Bruno, Burlington, MA (US); Steven M Bourque, Billerica, MA (US); Hubert F Carneiro, Revere, MA (US)

(73) Assignee: The Gillette Company, Boston, MA (US)

( * ) Notice: Subject to any disclaimer, the term of this patent is extended or adjusted under 35 U.S.C. 154(b) by 160 days.

(21) Appl. No.: 14/070,076

(22) Filed: Nov. 1, 2013

(65) Prior Publication Data

US 2015/0121704 A1 May 7, 2015

(51) Int. Cl.
*B26B 21/44* (2006.01)

(52) U.S. Cl.
CPC ..... *B26B 21/446* (2013.01)

(58) Field of Classification Search
CPC ..... B26B 21/4018; B26B 21/446
See application file for complete search history.

(56) References Cited

U.S. PATENT DOCUMENTS 4,850,107 A * 7/1989 Valliades et al. ..... 30/41
4,872,263 A * 10/1989 Etheredge, III ..... 30/41
5,113,585 A * 5/1992 Rogers et al. ..... 30/41
5,653,971 A * 8/1997 Badin et al. ..... 424/73
5,918,369 A * 7/1999 Apprille et al. ..... 30/47
6,182,365 B1 * 2/2001 Tseng et al. ..... 30/34.2
6,185,822 B1 * 2/2001 Tseng et al. ..... 30/41
6,298,558 B1 * 10/2001 Tseng et al. ..... 30/41
6,594,904 B1 * 7/2003 Tseng ..... 30/41
6,789,321 B2 * 9/2004 Simms ..... 30/41
6,944,952 B1 * 9/2005 Tseng ..... 30/41
7,069,658 B2 * 7/2006 Tseng ..... 30/41
7,127,817 B2 * 10/2006 Orloff et al. ..... 30/41
7,168,173 B2 * 1/2007 Worrick, III ..... 30/527
8,209,867 B2 * 7/2012 Clarke ..... 30/34.2
2006/0080837 A1 * 4/2006 Johnson et al. ..... 30/50
2006/0240380 A1 * 10/2006 Chenvainu et al. ..... 433/80
2010/0236071 A1 * 9/2010 Szczepanowski et al. ..... 30/41.5
2011/0146080 A1 6/2011 Pauw
2011/0219621 A1 9/2011 Royle et al.
2012/0102761 A1 5/2012 Jessemey et al.
2012/0233863 A1 * 9/2012 Clarke ..... 30/34.2
2013/0145625 A1 6/2013 Xu et al.

OTHER PUBLICATIONS

PCT International Search Report and Written Opinion for PCT/US2014/063274 dated Feb. 13, 2015.

* cited by examiner

*Primary Examiner* — Hwei C Payer
(74) *Attorney, Agent, or Firm* — Ronald Terk Sia; Kevin C. Johnson; Steven W. Miller

(57) ABSTRACT

The invention features a razor for dispensing a fluid during shaving. The razor includes a handle, a razor cartridge, and a fluid dispensing member joined to the cartridge. The handle includes a cavity for housing a fluid and a manually-actuated pump to displace the fluid from the cavity through a connector port flowpath to an opening at the proximal end of the handle. The razor cartridge includes a cartridge connecting structure attached to the housing and an aperture that extends from the rear surface to the front surface of the housing. The fluid dispensing member is disposed in the cartridge connecting structure and includes a converging flowpath that is in fluid communication with the connector port flowpath and the aperture in the housing.

17 Claims, 11 Drawing Sheets

MANUALLY ACTUATABLE LIQUID DISPENSING RAZOR

FIELD OF THE INVENTION

This invention relates to a manually actuatable liquid dispensing razor.

BACKGROUND OF THE INVENTION

This invention relates to the field of wet shaving which is the process where a razor with one or more sharpened blades is moved along skin to cut hair. When a consumer engages in the wet shaving experience, it is typical to apply a skin preparation, e.g., shaving soap, shaving cream, shaving gel, skin conditioning foam, etc., via a brush or manual application prior to movement of the razor along the skin's surface. Most consumers find this type of preparation to be rather inconvenient because of the need for multiple shaving products, e.g., a wet razor and a skin preparation product, as well as the undesirable necessity for multiple application steps during the wet shaving process. This multi-step process also results in an overall extended shaving experience which most consumers do not prefer given typical morning hygiene routines. It may, however, be desirable sometimes to apply fluids of other kinds to the skin before, during, or after shaving. It has been found that especially in the case of males who shave facial hair, it is important to provide a shave preparation of some sort prior to shaving in order to adequately hydrate the coarser facial hairs to allow for an easier and closer shave.

In the past, there have been a number of wet shaving product configurations that include a system for conveying a shaving preparation during shaving, e.g., a lubricating fluid, from a reservoir incorporated in the razor structure in the form of a hollowed out razor handle or even an aerosol can that acts as a razor handle, to a dispensing location near the head of the razor. A number of more recent wet razors have cartridges that are movably mounted, in particular pivotable, relative to the handle structures on which they are mounted either permanently, in the case of disposable safety razors intended to be discarded when the blade or blades have become dulled, or detachably to allow replacement of the blade unit on a reusable handle structure. An exemplary razor of this sort is disclosed in U.S. Pat. No. 6,789,321 or U.S. Pat. No. 7,127,817. Many of these types of razors that are capable of conveying a liquid to the skin surface are unfortunately plagued by a number of problems. For instance, the inner workings of the razors tend to be cost prohibitive from a large scale manufacturing standpoint. Additionally, there are safety and performance issues that are constantly experienced due to microbial growth with the reservoir due to the continued exposure of a portion of the remaining liquid to air. This exposure of the liquid to air may oftentimes result in clogging of the razor's inner workings by the liquid resulting in a nonperforming shaving product.

Although there are known deficiencies with liquid dispensing razors there is a need for a razor that capable of dispensing a liquid during shaving that is cost effective and reliable. Particularly, there is a need a liquid dispensing wet shaving razor that can dispense a composition during shaving when the skin needs it most that overcomes the aforementioned clogging and microbial growth problems.

SUMMARY OF THE INVENTION

In an aspect, the invention features a wet shaving razor for dispensing a fluid during shaving. The wet shaving razor comprises a handle and a razor cartridge including a housing with an aperture, a cartridge connecting structure, and a fluid dispensing member disposed in the cartridge connecting member. The handle has a length that extends from a proximal end to a distal end. The handle includes a cavity for housing a reservoir of fluid disposed within the handle near the distal end, a connector port disposed at the proximal end and a manually-actuated pump located along the length of the handle between the reservoir and the connector port.

The connector port comprises a connector port supply end having an opening and a connector port discharge end having an opening with a connector port flowpath therebetween. The connector port flowpath includes a converging cross-section, such that the cross-section of the connector port flowpath decreases from the supply end opening to the discharge end opening. Alternatively, the connector port comprises a Y-shaped flowpath where the connector port supply end has one opening and the connector port discharge end has two openings with the connector port Y-shaped flowpath therebetween. For this embodiment, the connector port flowpath comprises a supply end flowpath leading to two discharge end flowpaths. The supply end flowpath and two discharge end flowpaths include converging cross-sections, such that the cross-sections of each of the flowpaths decreases in the direction of flow.

The razor cartridge includes a housing having a top portion, bottom portion, front surface, and rear surface; and a cartridge connecting structure attached to the rear surface of the housing. At least one blade is positioned between the top portion and the bottom portion of the housing and an aperture located between the top portion and the bottom portion extends from the rear surface to the front surface. The razor cartridge is pivotally connected to the cartridge connecting structure and may be removably connected to the connecting structure. Additionally, the razor cartridge may include a guard as well as an elastomeric member disposed on the guard.

A fluid dispensing member is joined to the cartridge connecting structure. The fluid dispensing member includes at least one, preferably two flowpaths, wherein each flowpath has a fluid dispensing member opening at a fluid dispensing member supply end and two fluid dispensing member openings at a fluid dispensing member discharge end. The fluid dispensing member flowpaths converge from the fluid dispensing member supply ends to the fluid dispensing member discharge ends such that the cross-sections of the flowpaths decrease from the supply end openings to the discharge end openings. The fluid dispensing member discharge end openings extend to or adjacent to the aperture in the housing allowing for direct contact to a user during shaving. The fluid dispensing member is in fluid communication with the reservoir and pump via the connector port when the cartridge connecting structure engages the proximal end of the handle.

A hollow space or cavity may be interposed between the connector port discharge end opening and the dispensing member supply end openings for the connector port configuration having the single converging flowpath design. The hollow space or cavity may be formed as part of the cartridge connecting structure. For the connector port configuration including the Y-shaped flowpath, the two discharge ends of the connector port flowpath may interface directly with the fluid dispensing member supply end openings.

In an another embodiment, razor cartridge includes a housing, a cap, and at least one blade mounted to the housing. The blade has a blade edge in front of the cap. A guard in front of the blade. The guard defines an elongated recess or trough having an overall width extending parallel to the blade that is 70% to 100% of an overall width of the guard. The elongated recess is in fluid communication with the fluid dispensing member discharge end opening via the apertures in the cartridge housing and may be filled with fluid pumped from the reservoir.

In order to accommodate the flow of fluid for the entire pivot range of the cartridge, the fluid dispensing member discharge end openings are flared. The external surfaces of the fluid dispensing member adjacent the discharge end openings are curved concave toward the opening while the internal surfaces of the openings form a beveled edge. The flared openings interface with the apertures in the housing. An elongated recess or trough in the guard that is in fluid communication with the apertures can provide an even distribution of fluid along the length of the blades. Microcombs in the guard between the trough and the blades can evenly distribute fluid across the blade span.

A pump is disposed between the reservoir and the connector port. The pump can comprise a resilient tube interposed between first and second connectors, where the first and second connectors include first and second valves, respectively. The first connector attaches to the reservoir and the second connector attaches to the connector port opening. The resilient tube has a neutral position with both valves closed and a second position with one valve open and one valve closed.

The fluid is stored in a reservoir disposed in a cavity at the distal end of the handle opposite the connector port. The reservoir is replaceable and comprises an outer container enclosing a collapsible inner container and includes a fluid outlet adapted to allow fluid to exit both the collapsible reservoir and the container. An orifice disposed in the outer container is adapted to allow air to flow in or out of the container. The fluid outlet is in fluid communication with the pump which sucks fluid out of the collapsible reservoir. The fluid outlet may include a frangible seal which is penetrated by a piercer on the end of the first connector during connection of the reservoir to the pump. The reservoir can be disposed at the distal end of the handle and can comprise an exposed container or bottle or covered by an end cap.

Other features and advantages of the invention will be apparent from the description and drawings, and from the claims.

DETAILED DESCRIPTION OF THE INVENTION

Figure 1:
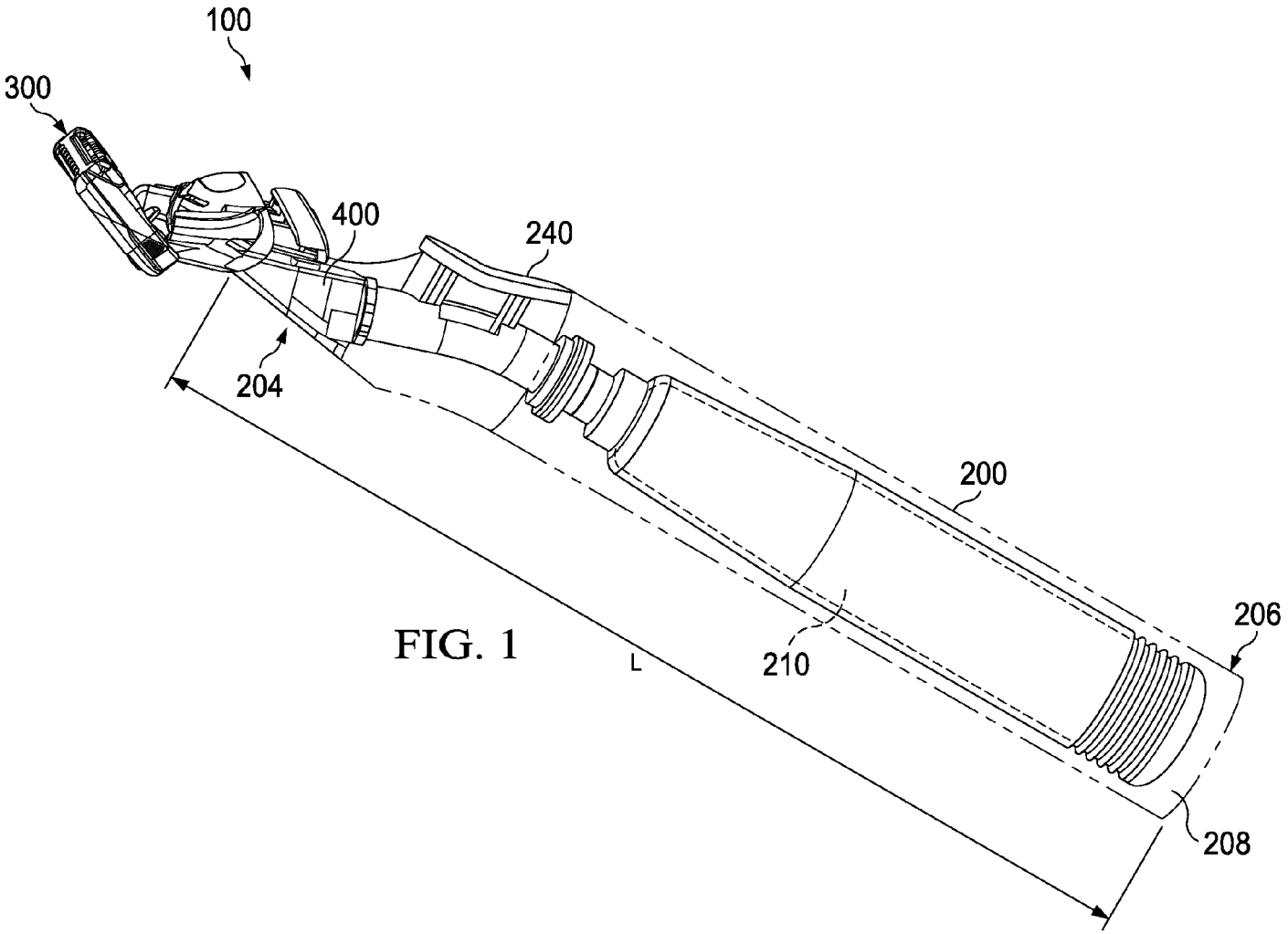
FIG. 1 is a side view of a wet shaving razor of the present invention.
Figure 2:
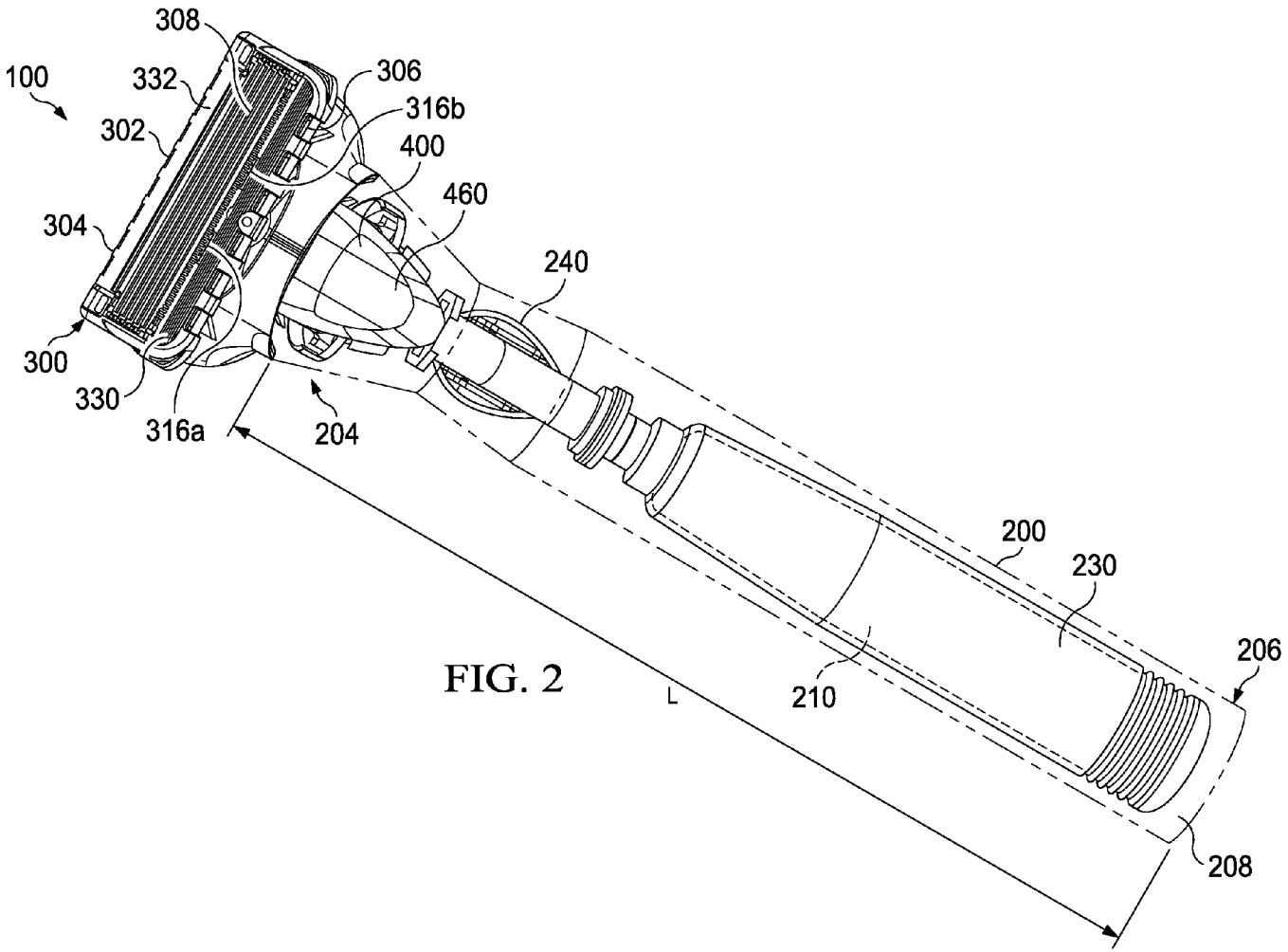
FIG. 2 is a bottom view of a wet shaving razor of the present invention.
Figure 3:
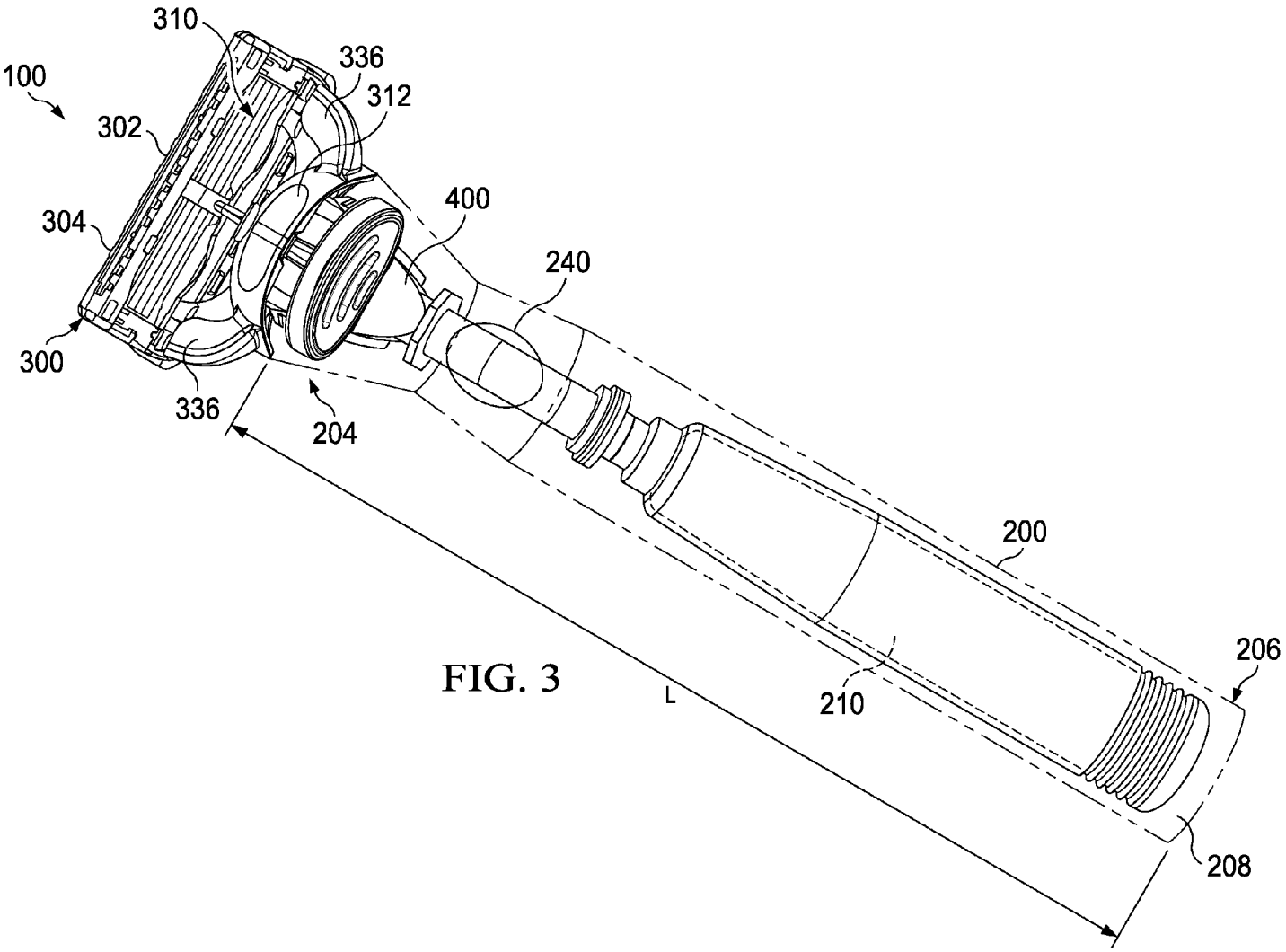
FIG. 3 is a top view of a wet shaving razor of the present invention.

FIGS. 1-3 show a liquid dispensing wet shaving razor (100) for dispensing a fluid during shaving that includes a handle (200) and a razor cartridge (300). The handle (200) has a length (L) that extends from a proximal end (204) to a distal end (206). The handle also includes a cavity (208) for housing a reservoir (230) disposed within the handle (200) and a manually-actuated pump (240) located along the length (L) of the handle (200). The pump assembly (240) is adapted to displace the fluid from the reservoir (230) to a connector port (400) at the proximal end (204) of the handle (200).

Referring to FIGS. 1-3, the razor cartridge (300) includes a housing (302) having a top portion (304), bottom portion (306), front surface (308), and rear surface (310). At least one blade (314) is positioned between the top portion (304) and the bottom portion (306). The razor cartridge (300) may also include multiple blades. For example, U.S. Pat. No. 7,168,173 generally describes a Fusion® razor that is commercially available from The Gillette Company which includes a razor cartridge with multiple blades. Additionally, an aperture (316) is located between the top portion (304) and the bottom portion (306) such that the aperture (316) extends from the rear surface (310) to the front surface (308). In an embodiment, the housing (302) may also contain clips that are useful for retaining and maintaining the stability of the blades before, during, and after use of the razor.

The cartridge (300) attaches to the rear surface (310) of the housing (302) by a cartridge connecting structure (312). The cartridge connecting structure (312) includes two arms (336) that extend to provide pivotal support of the housing (302). The cartridge is able to pivot about a predetermined axis located beneath the guard surface (330). (Apertures 316*a* and 316*b* are preferably located at or near the pivot axis fully described below).

The razor cartridge (300) may also include a guard (330) and/or lubricating strip 332 on the front surface (308) located between the top portion (304) and bottom portion (306) of the housing (302). The guard (330) is useful for stretching the skin's surface immediately prior to engagement with the blade or a first blade (when more than one blade is present). This guard (330) may typically comprise an elastomeric member to allow for an engagement that is comfortable to a user. U.S. Pat. No. 7,168,173 discloses a suitable razor cartridge and elastomeric material without the apertures. The elastomeric material can be selected as desired. Typically, the elastomeric material used is a block copolymer (or other suitable materials), e.g., having a durometer between 28 and 60 Shore A.

Figure 5:
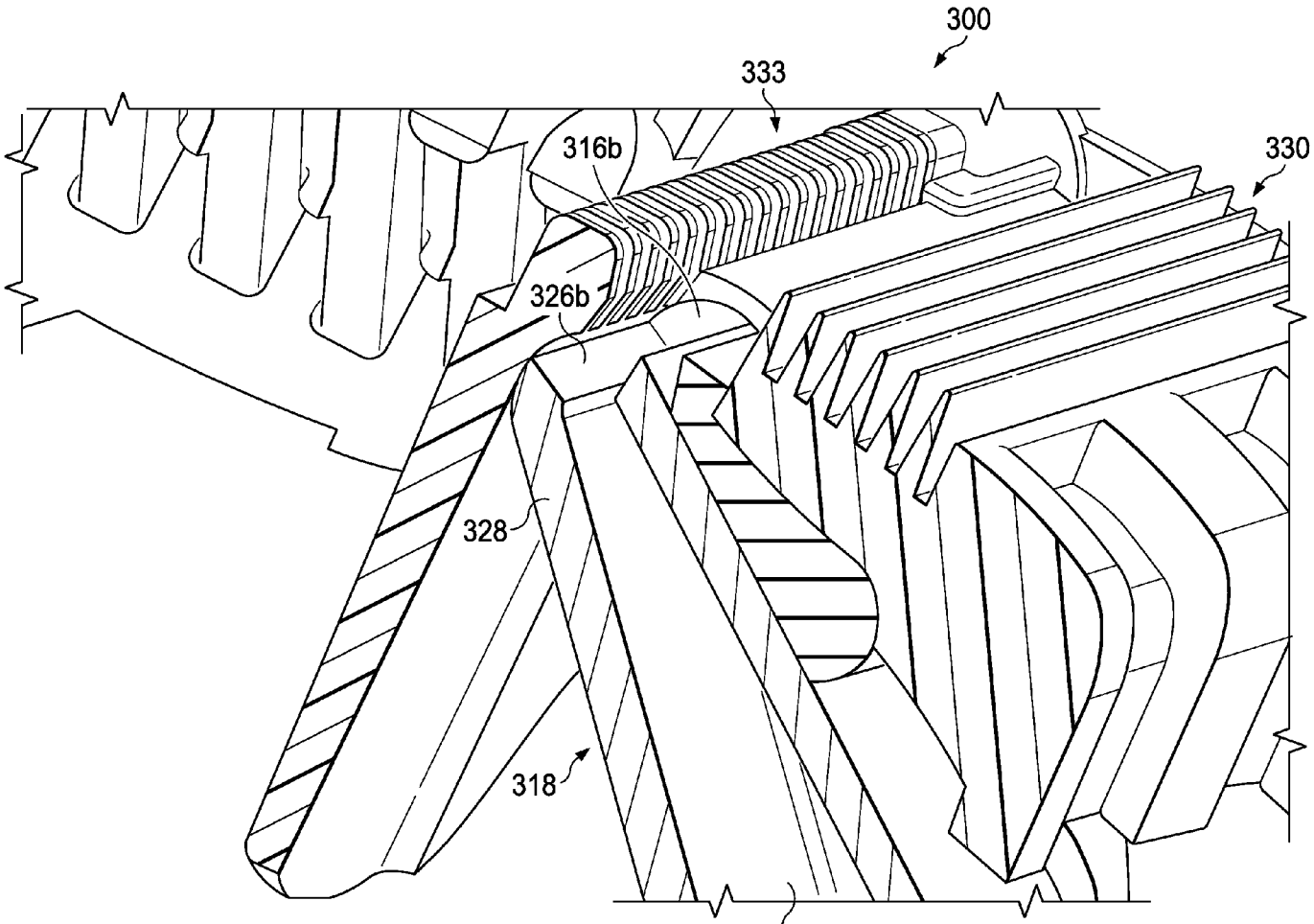
FIG. 5 is a perspective view of a cross-section of the razor cartridge of the wet shaving razor shown in FIGS. 1-3.

The razor cartridge may also include a micro comb (333) Shown in FIG. 5 and disclosed in U.S. Pat. No. 8,209,867. The micro comb (333) includes a plurality of projections defining a plurality of open slots extending generally perpendicular to the blade edge. The open slots have a minimum dimension to allow free passage of hair to the blade edge and a maximum dimension which prevents skin bulge between the slots. The micro combs are disposed between the blade edge and the apertures (316*a* and 316*b*) in the housing and serve as flow channels providing an even distribution of fluid in front of the blade edge.

The lubricating strip, on the other hand, provides an additional treatment to the skin after contact between the fluid and the skin has occurred. The lubricating strip may contain the same or additional skin ingredients to those that are present in the fluid. Suitable lubricating strips are disclosed in U.S. Pat. Nos. 7,069,658, 6,944,952, 6,594,904, 6,182,365, D424,745, 6,185,822, 6,298,558 and 5,113,585. The lubricating strip may be located anywhere on the cartridge and contains electrolyte that is released to the skin which further facilitates the spreading of the polymer thickened/suspended ingredients. The electrolyte can be charged polymers, salts, surfactants or mixtures therein.

The cartridge connecting structure (312) may be releasably attached to the handle (200), as disclosed in U.S. Pat. Nos. D533,684, 5,918,369, and 7,168,173. This disengagement of these two components allows for replacement of razor cartridges as the continued use of such cartridges causes blade dulling. Thus, such cartridges are replaceable and disposable at will by the user.

The razor cartridge 300 comprises a pivot axis about which the cartridge housing 302 is mounted to the cartridge connecting structure (312). In one embodiment, the one or more apertures 316*a* and 316*b* in the front surface 308 of the cartridge are positioned at or close to the pivot axis. The one or more aperture(s) allow fluid to be discharged directly to the skin at or near the predetermined pivot axis. Non-limiting examples of devices having similar placement of the discharge positions of fluid are available in U.S. Pat. No. 6,789,321. In one embodiment the device comprises a plurality of orifice(s) wherein one or more of said plurality of orifice(s) are positioned at or close to the pivot axis. The one or more of orifice(s) can generally form a line extending for a portion of said pivot axis. The device could also have just one orifice which has a generally elongated shape extending sideways towards the lateral ends of the razor cartridge, extending for a portion of the pivot axis. By providing one or more orifice(s) positioned along a portion of any fluid dispensed at the pivot axis would have a greater chance of forming a thin but wide ribbon of the fluid. Non-limiting examples of suitable orifices are provided herein and also available in U.S. Published Patent Application US 20110219621 A1.

Fluid Dispensing Member

Figure 4A:
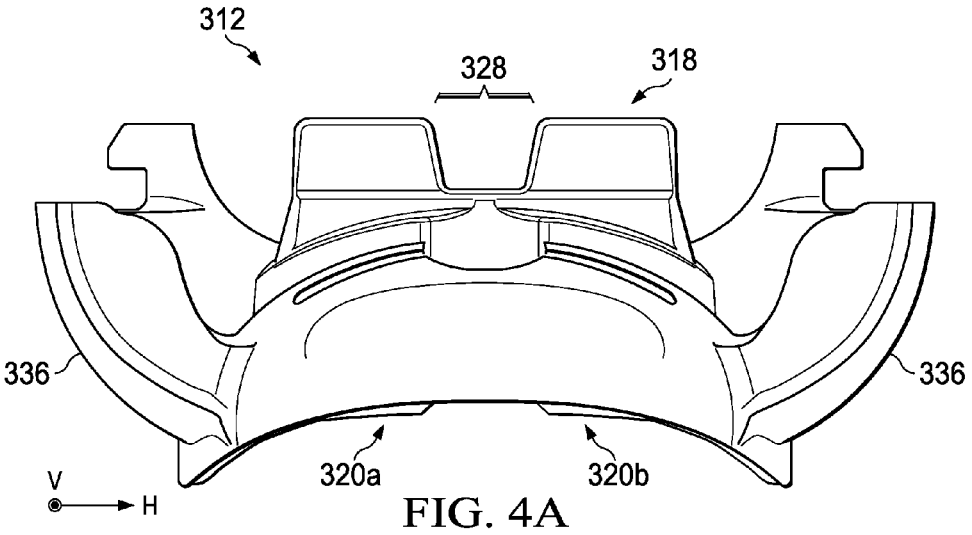
FIG. 4*a* is a top view of a razor cartridge connecting structure of the present invention.
Figure 4B:
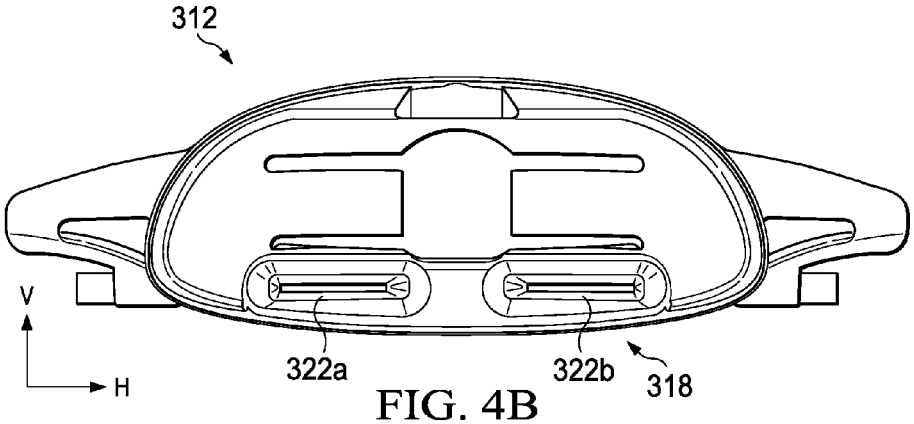
FIG. 4*b* is a rear view of a razor cartridge connecting structure of the present invention.
Figure 4C:
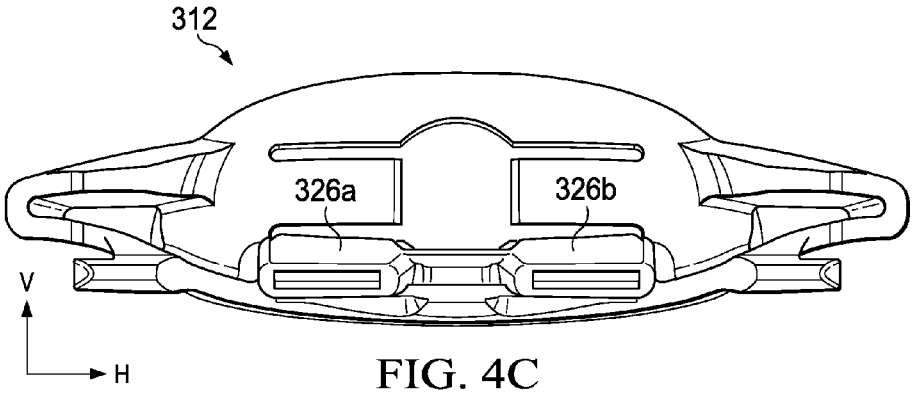
FIG. 4*c* is a front view of a razor cartridge connecting structure of the present invention.

The razor cartridge shown in FIGS. 4*a*-4*c* comprises a fluid dispensing member (318) joined to the cartridge connecting structure (312). The fluid dispensing member (318) includes two dispensing member flowpaths 320*a* and 320*b* with two dispensing member supply end openings 322*a* and 322*b* and two dispensing member discharge end openings 326*a* and 326*b*. The two fluid dispensing member supply end openings 322*a* and 322*b* are in fluid communication with the connector port discharge end opening(s) when the cartridge connecting structure engages the proximal end of the handle and the two dispensing member discharge end openings (326*a* and 326*b*) are in fluid communication with the apertures 316*a* and 316*b* in the housing 302. The dispensing member flowpaths (320*a* and 320*b*) converge from the dispensing member supply end openings (322*a* and 322*b*) to the dispensing member discharge end openings 326*a* and 326*b* such that the cross-sections of the dispensing member flowpaths (320*a* and 320*b*) decrease from the two dispensing member supply end openings (322*a* and 322*b*) to the two dispensing member discharge end openings (326*a* and 326*b*). The cross sections of the dispensing member flowpaths (320*a* and 320*b*) can decrease continuously from the supply end openings (322*a* and 322*b*) to the discharge end openings (326*a* and 326*b*). The cross sections may decrease in the horizontal direction H, vertical direction V or both. For instance, the cross sections of the flowpaths (320*a* and 320*b*) for the dispensing member 318 in the connecting structure (312) shown in FIGS. 4*b* and 4*c*, decrease in both the horizontal H and vertical directions V. Upon engaging the fluid dispensing member supply end openings 322*a* and 322*b* with the connector port discharge end opening(s), the fluid dispensing member (318) is in fluid communication with the pump (240) and actuation of the pump (240) displaces the fluid from the reservoir (230) in the cavity (208) through the apertures (316) to or adjacent to the front surface (308) of the housing (302).

If a clog or problem occurs in the flowpaths (320*a*) and (320*b*) and/or the razor cartridge (300), e.g., blades become dull, a user can simply replace the cartridge (300) and accompanying fluid dispensing member (318). The fluid dispensing member (318) may be integrally formed with the cartridge connecting structure (312). For example, the fluid dispensing member (318) may be molded and/or formed as a single assembly with the cartridge connecting structure (312).

The dispensing end (328) of the dispensing member (318) extends to or adjacent to the apertures 316*a* and 316*b* in the housing (302). In the partial view of the cartridge housing 302 and fluid dispensing member 318 dispensing end 328 shown in FIG. 5, the dispensing end (328) engagably mates with the razor cartridge (300) at the aperture (316*b*). To prevent the fluid from leaking while the razor (100) is not in use, any or all of the openings (e.g., 322*a*, 322*b*, 326*a* and 326*b*) may include a check valve, e.g., a slit valve, a duck valve, or other suitable valves.

As shown in FIG. 5, the fluid dispensing member (318) has discharge end openings (326*a*, 326*b*) at the dispensing end (328) and the razor cartridge (300) includes apertures (316*a*, 316*b*). Discharge end openings (326*a* and 326*b*) in the dispensing end (328) of the fluid dispensing member (318) can be beveled. As shown, edges of the discharge end openings (326*a* and 326*b*) are disposed at an angle relative to the openings to accommodate an entire pivot range of the razor cartridge 300. In this embodiment, the dispensing end (328) projects outwardly and extends into the plurality of apertures (316*a*, 316*b*) to or adjacent to the front surface (308). Upon engaging the supply end openings (322*a* and 322*b*) of the fluid dispensing member (318) with the connector port flowpath (440), the fluid dispensing member (318) is in fluid communication with the pump (240). Actuation of the pump (240) displaces the fluid (210) from the reservoir (230) through the apertures (316*a*, 316*b*) to or adjacent to the front surface (308) of the housing (302).

Connector Port

Figure 6A:
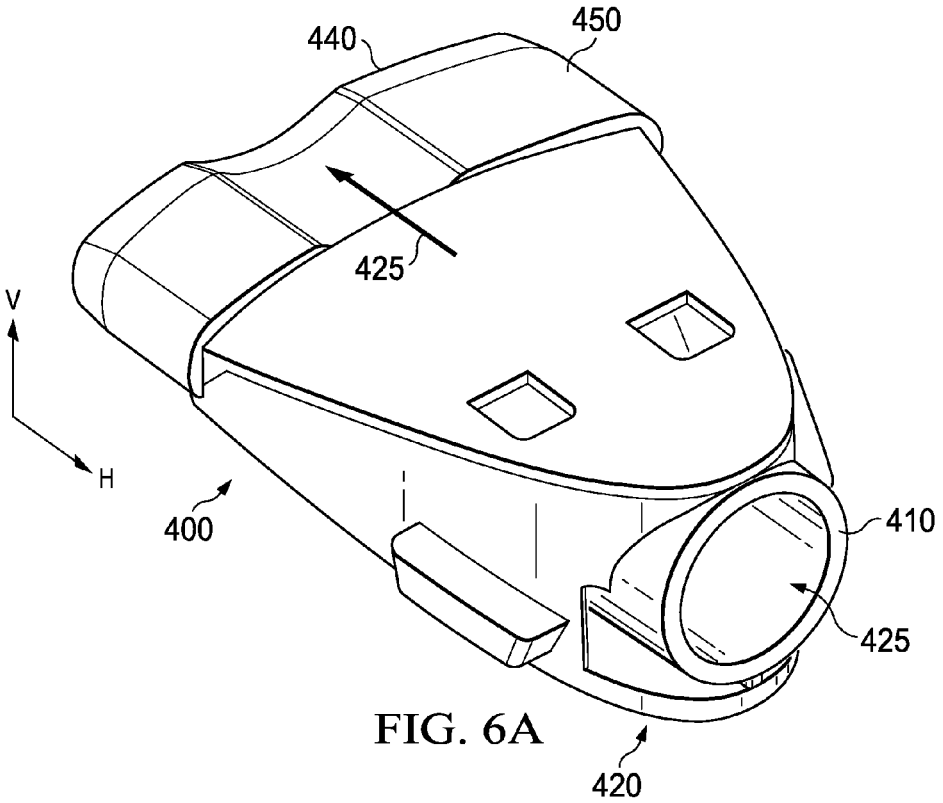
FIGS. 6*a* and 6*b* are perspective views of a connector port of the wet shaving razor shown in FIGS. 1-3.
Figure 6B:
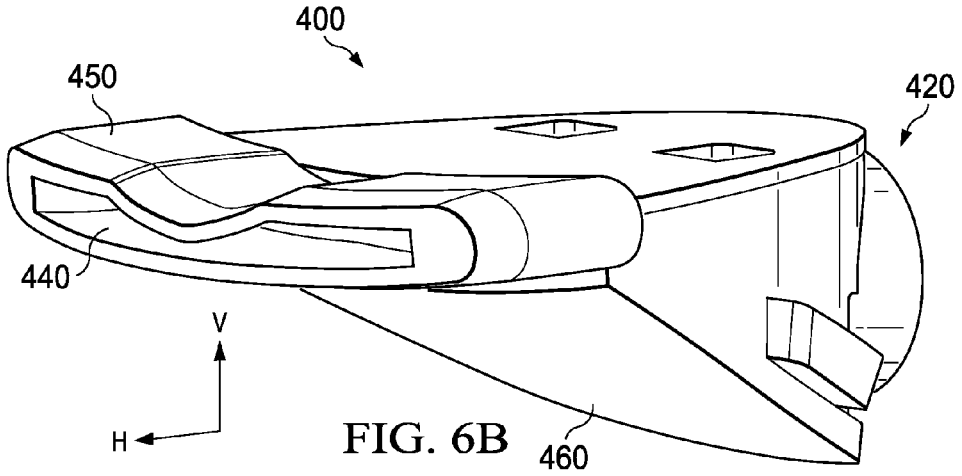

The connector port 400 shown in FIGS. 6*a* and 6*b* comprises a connector port supply end 420 having an opening 410 and a connector port discharge end (450) having an opening (440) with a connector port flowpath 425 therebetween. The connector port flowpath 420 includes a converging cross-section, such that the cross-section of the connector port flowpath contracts from the supply end opening 410 to the discharge end opening 440. The decrease in cross-section refers to the reduction in area as the flowpath progresses from the supply end opening 410 to the discharge end opening 440 along the flowpath. For the connector port shown in FIGS. 6*a* and 6*b*, the cross-sections may decrease in the horizontal direction H, vertical direction V or both. For instance, the cross-section of the flowpath (425) for the connector port (400) shown in FIGS. 6*a* and 6*b*, decreases in the vertical direction V.

In order to provide a visual indication of the fluid flowing though the razor assembly, the connector port 400 may include a transparent or translucent window providing a visual indication that the fluid is flowing through the connector port 400. The transparent or translucent window may be disposed on any portion of the connector port that is exposed. As shown in FIG. 2 and FIG. 6*b* the bottom portion 460 of the connector port 400 may comprise a transparent or translucent window that is exposed on the bottom portion of the liquid dispensing wet shaving razor (100).

Figure 7:
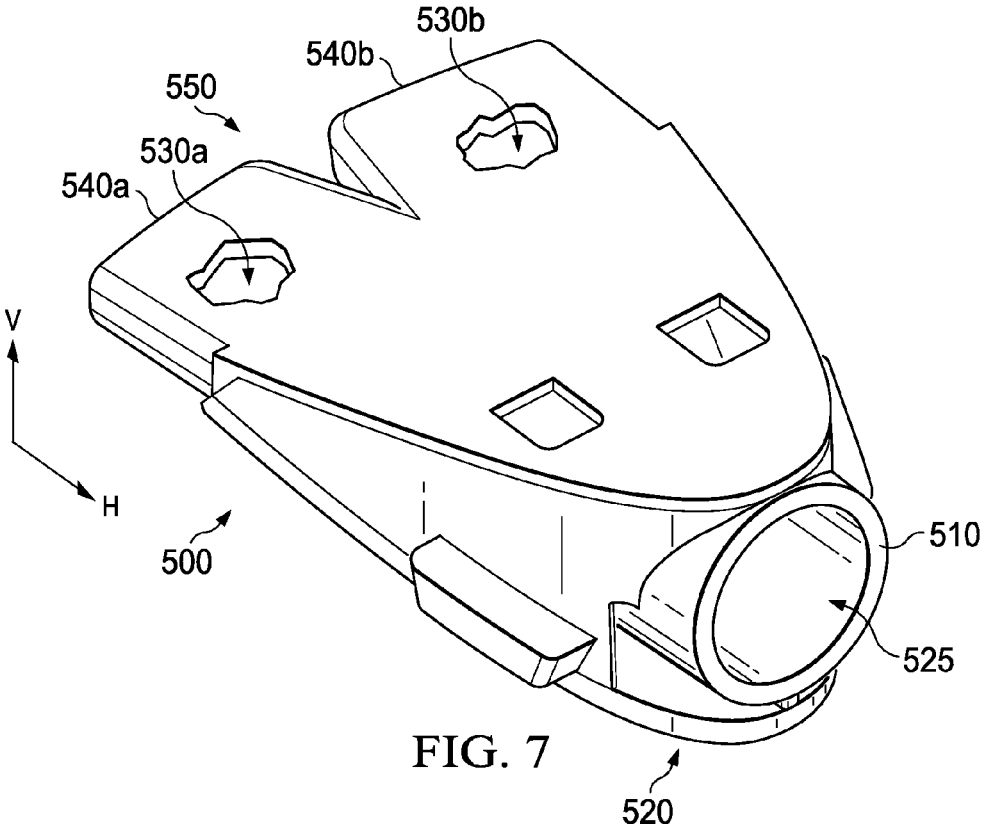
FIG. 7 is a perspective view of an alternate embodiment of the connector port shown in FIGS. 6*a* and 6*b*.

As shown in FIG. 7, the connector port 500 can have two connector port discharge end openings 540*a* and 540*b* that connect to a single connector port supply end opening 510 with a Y-shaped flowpath therebetween. The Y-shaped flowpath comprises a supply end flowpath 520 leading to two discharge end flowpaths 530*a* and 530*b*. The supply end flowpath 520 and two discharge end flowpaths 530*a* and 530*b* include converging cross-sections, such that the cross-sections of each of the flowpaths decrease in the direction of flow. As previously described, the decrease in cross-section refers to the decrease in area as the flowpath progresses from the supply end opening 510 to the discharge end opening 540 along the flowpath. The cross sections may decrease in the horizontal direction, vertical direction or both. For the connector port shown in FIG. 7, the connector port supply end flowpath 520 cross section decreases in the vertical direction V and the two connector port discharge end flowpaths 530*a* and 530*b* decrease in the horizontal H and vertical V directions.

Converging flowpaths in both the connector port and the dispensing member are preferably smoothly converging in that they converge in a continuous manner as opposed to converging in an interrupted a step like manner along the flowpath. This produces a uniform fluid flow field that exhibits a minimal pressure drop along the flowpath in the direction of flow with a maximum pressure drop occurring at the discharge end openings of the dispensing member. This helps to prevent build up where clogging is most likely to occur. The uniform flow field also exhibits a continuous increase in velocity resulting in no stagnant or recirculation areas along the flowpath which reduces clogging and prevents bacteria build up by ensuring fluid that is first in is first out. In addition, due to the uniform flow field, the force required to actuate the pump is reduced resulting in a low actuator (button) force required to dispense fluid during use as well as lessens the need for priming the pump.

Pump

Figure 8:
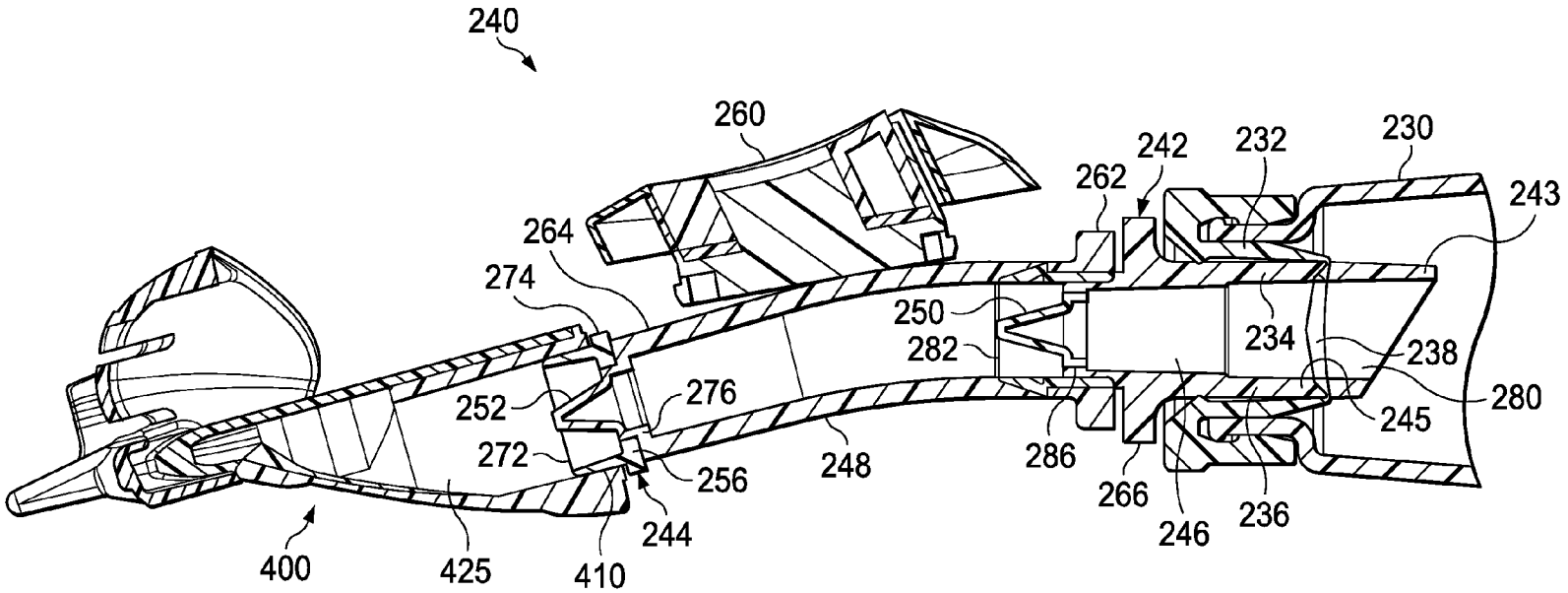
FIG. 8 is a cross-sectional view of the pump of the wet shaving razor shown in FIGS. 1-3.

The pump for the liquid dispensing razor according to the present invention is a manually actuated pump that can transport fluid by repeatedly depressing an actuator or button. An assembly view of such a pump assembly 240 is illustrated in FIG. 8. The pump assembly 240 includes a flexible tube 248 interposed between a first connector 242 and a second connector 244 and an actuator (button) 260 therebetween. A first valve 250 is disposed in the first connector 242 and a second valve 252 is disposed in the second connector 244. The first fluid connector 242 includes a tip 243 that may pierce a frangible seal 238 in the opening 232 of the fluid reservoir 230 to establish a fluid connection between the pump 240 and the fluid reservoir 230. The outer wall 245 of the first fluid connector 242 may seal against an inner wall 234 of the fluid reservoir 230 to prevent fluid from leaking into the cavity 208 of the handle 200. Accordingly, fluid is directed within an opening 246 of the first fluid connector 242, which is in fluid communication with a pump assembly 240. The elongated resilient tube 248 pumps fluid from the fluid reservoir 230 through valves 250 and 252 to the connector port 400.

An actuator 260 (e.g., a button) facilitates pumping of the fluid from the fluid reservoir 230 to the connector port 400. For example, the actuator 260 may compress the resilient elastomeric tube 248 to open the second valve 252 and release a predetermined dosage of fluid to the connector port 400. The actuator 260 may be released to return the resilient elastomeric tube 248 to its uncompressed state. As the resilient elastomeric tube 248 returns to its uncompressed state, the second valve 252 closes to prevent back flow of the fluid and corresponding contamination associated therewith and the first valve 250 opens allowing the resilient elastomeric tube 248 to fill with fluid for the next release by the actuator 260. This is a repetitive process that is fully described below.

As shown in FIG. 8, the second connector 244 is coupled to and in liquid communication with the connector port 400. For example, a first end 272 of the second connector 244 may be press fit within the connector port 400 supply end opening 410. The second connector 244 has a second end 274 with an opening 276 dimensioned to receive the second valve 252. The second end 274 of the second connector 244 is coupled to and in liquid communication with the pump 240. The elongated resilient tube 248 has a second end 264 connected to the second end 274 of the second connector 244. The second connector 244 includes a shoulder 256 to prevent the first end 272 of the second connector 244 from extending too far into the supply end opening 410 of the connector port 400. The resilient tube 248 has a first end 262 coupled to and in liquid communication with the first connector 242. The first connector 242 may be semi-rigid and have a second end 282 press fit into the first end 262 of the resilient tube 248. The first connector 242 second end 282 has an opening 286 extending through the first connector 242. The opening 286 is dimensioned to receive a first valve 250 (e.g., a duckbill valve). The first connector 242 may have a first end 280 press fit into the opening 232 of the reservoir 230. The first connector 242 first end 280 includes the tip 243 for piercing the frangible seal 238 in the reservoir opening 232. The first connector 242 includes a shoulder 266 to prevent the first end 280 of the first connector 242 from extending too far into the reservoir opening 232 and the second end 282 from extending too far into the resilient tube 248.

The valves 250 and 252 may be one way valves (e.g., check valves, clack valves, and non-return valves) that are connected in series. Examples of one way valves that may be used include, but not limited to ball check valves, swing check valves or tilting disc check valves, stop-check valves, lift-check valves, and duckbill valves. The positioning of the valves 250 and 252 within the first and second connectors 242, 244 saves space and also helps prevent the valves 250 and 252 from moving out of position.

Figure 9:
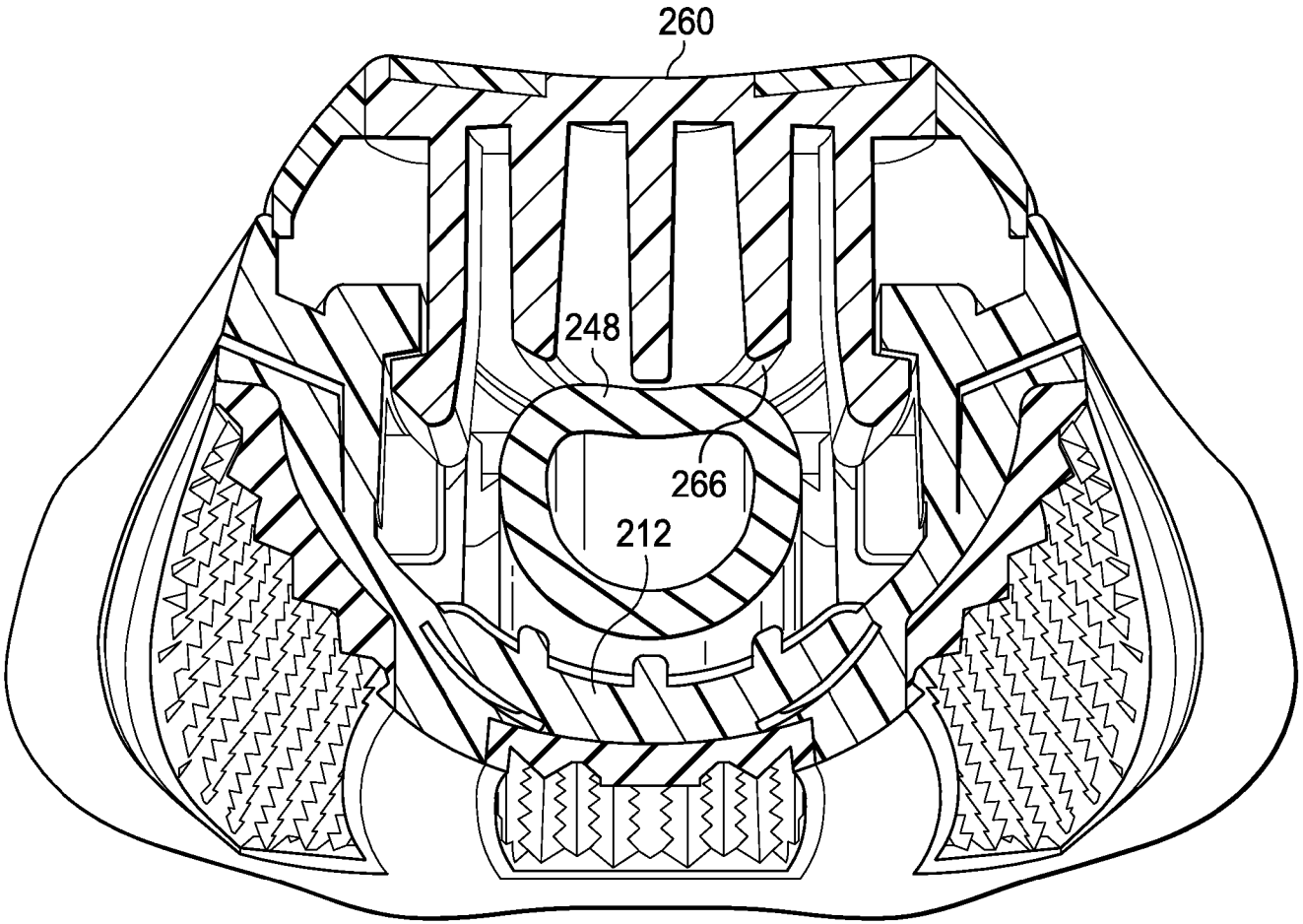
FIG. 9 is a cross-sectional view of the pump shown in FIG. 8.

In certain embodiments, the actuator 260 may directly contact and compress the resilient tube 248. FIG. 9 shows a cross section of an actuator 260 for a pump 240 according to the present invention. The bottom portion 266 of the actuator 260 may be shaped to match the inside contour of the handle cavity 208 and curved optimally front to back to minimize stress to the resilient tube 248. Although the actuator can be positioned anywhere along the length of the resilient tube 248 between the first and second valves 250, 252 it is preferably located in the center of the resilient tube 248.

When pressed, the actuator 260 compresses the resilient tube 248 opening the second valve 252, while first valve 250 remains closed. The first and second valves 250 and 252 may each have a flattened end when closed. The flattened ends open to permit liquid to pass when pressure is applied and close to prevent liquid back flow when pressure is removed (e.g., when the actuator 260 is released from the resilient tube 248). The first valve 250 opens (and the second valve 252 closes) when negative pressure is achieved within the resilient tube 248 (e.g., when the actuator 260 is released and no longer compressing the resilient tube 248, allowing it to return to its uncompressed state). The resilient properties (e.g., elongation at break and hardness) and the wall thickness may facilitate the resilient tube 248 returning to its natural state and achieve negative pressure within the resilient tube 248. When the second valve 252 is closed and the first valve 250 is open, liquid may travel from the reservoir 230, through the reservoir opening 234, through the first valve 250 and into the resilient tube 248. The positioning of a resilient tube 248 between a pair of one way valves positioned in series prevents back flow of shaving debris and microbes into the pump 240 and the reservoir 230. In certain embodiments, the resilient tube 248 may return the actuator 260 back to its original position. Accordingly, an additional return force member (e.g., a spring) is not necessarily required to return the actuator 260 back to its original position. The resilient tube 248 may be extruded or molded from materials having a Shore A hardness of about 40 to about 90 (ISO 868), including, but not limited to thermoplastic elastomers (TPEs), polyvinylchloride (PVC), silicones, rubbers, or any combination thereof. The resilient tube 248 may comprise a material having a tensile strength at break of about 8 MPa, 9 MPa, or 10 MPa to about 12 MPa, 13 MPa, or 14 MPa (ISO 37). The resilient tube 248 may comprise a material having a percent elongation at break of about 300% $mm^2$, 400%, or 500% to about 600% $mm^2$, 700%, or 800% (ISO 37). The resilient tube 248 may have a nominal wall thickness of about 0.5 mm, 0.75 mm, or 1 mm to about 1.25 mm, 1.5 mm, or 2 mm to provide sufficient flexibility to allow efficient compression of the resilient tube 248 by the actuator 260, but not too flexible such that the resilient tube 248 does not return to its original position after being repeatedly compressed.

Reservoir

Figure 10:
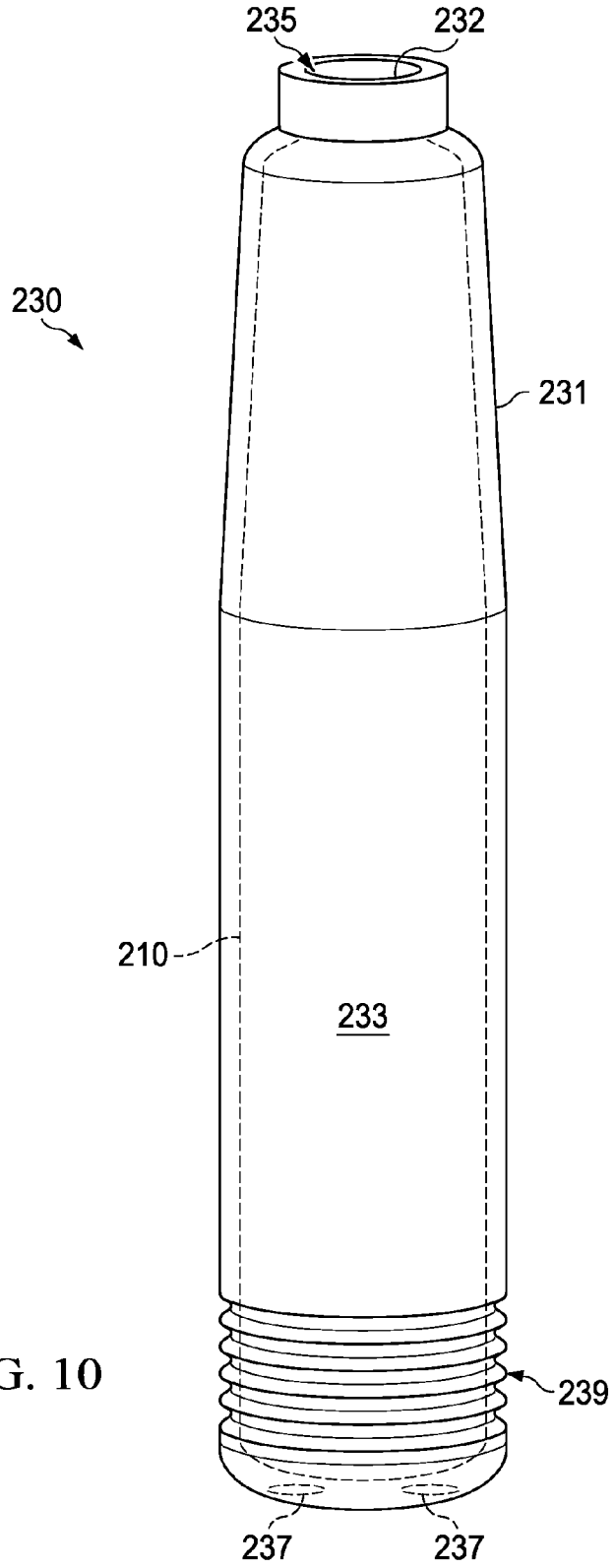
FIG. 10 is a side view of the reservoir of the wet shaving razor shown in FIGS. 1-3.

The cavity 208 includes a reservoir 230 housing a fluid 210. The reservoir 208 can include a replaceable bottle. FIG. 10 shows a reservoir 230 containing a fluid 210. The reservoir 230 includes an outer container (231), enclosing a collapsible reservoir (233). The container 231 and collapsible reservoir 233 have aligned openings which, together, form a fluid outlet (235) through which fluid may exit the collapsible reservoir (233) and container (231). One or more orifice(s) (237) in the container (231) allow air to flow into the container, thereby permitting pressure compensation as the collapsible reservoir (233) collapses. The reservoir shown in FIG. 10 also includes a plurality of ribs 239 circumscribing the bottom end of the container 231. The ribs 239 provide an outer surface that is easy to grip during removal of the container 231 from the cavity 208 and provide a collapsible accordion effect during insertion of the container 231 in the cavity 208 and connection of the fluid outlet 235 of the reservoir 230 to the first connector 242 of the pump 240. As the plurality of ribs collapse the container 231 compresses the collapsible reservoir 233 forcing fluid 210 from the collapsible reservoir 233 into the pump. This primes the pump 240, making it ready for use.

A fluid 210 (e.g., a lotion or gel) may be held within a fluid reservoir 230. Fluid reservoir 230 may be removed and replaced after the fluid 210 is consumed. The handle 200 may define a cavity 208 configured to receive the fluid reservoir 230. In certain embodiments, the fluid reservoir 230 may be a delaminating bottle or a sachet. In other embodiments, the fluid reservoir 230 may be a blow molded or injection molded plastic bottle.

As shown in FIG. 8 (previously described) the first connector 242 removably engages the fluid reservoir 230 to establish fluid connection between the fluid reservoir 230 and the pump assembly 240. The outer wall 245 of the first connector 242 may seal against an inner wall 236 of the fluid reservoir 230 to prevent fluid from leaking into the handle cavity 208. The first connector 242 includes tip 243 configured to pierce a seal (238) of the fluid reservoir 230 to establish a fluid connection between the pump assembly 240 and the fluid reservoir 230. In certain embodiments, the tip 243 may be beveled and/or angled (e.g., pyramidal, conical) to facilitate the penetration of the seal.

The container may have multiple chambers that allow fluids to mix upon being dispensed. The fluid may include shaving gels, shaving foams, shaving lotions, skin treatment compositions, conditioning aids, etc., all which may be used to prepare the skin's surface prior to the engagement of the blade with the skin. Additionally, such materials may comprise benefit agents suitable for skin and/or hair that may be useful for a number of different desirable effects including exfoliation, cooling effects, cleansing, moisturizing, warming or thermogenic effects, conditioning, and the like. Suitable benefit agents for skin and/or hair for inclusion into the fluid of the razor are disclosed in U.S. Pat. No. 6,789,321. For instance, suitable agents include but are not limited to shaving soaps, lubricants, skin conditioners, skin moisturizers, hair softeners, hair conditioners, fragrances, skin cleansers, bacterial or medical lotions, blood coagulants, anti-inflammatories, astringents, and combinations thereof. In certain embodiments, the fluid may be contained in a sachet, either disposable or reusable, that is further contained within the cavity of the handle.

Figure 11:
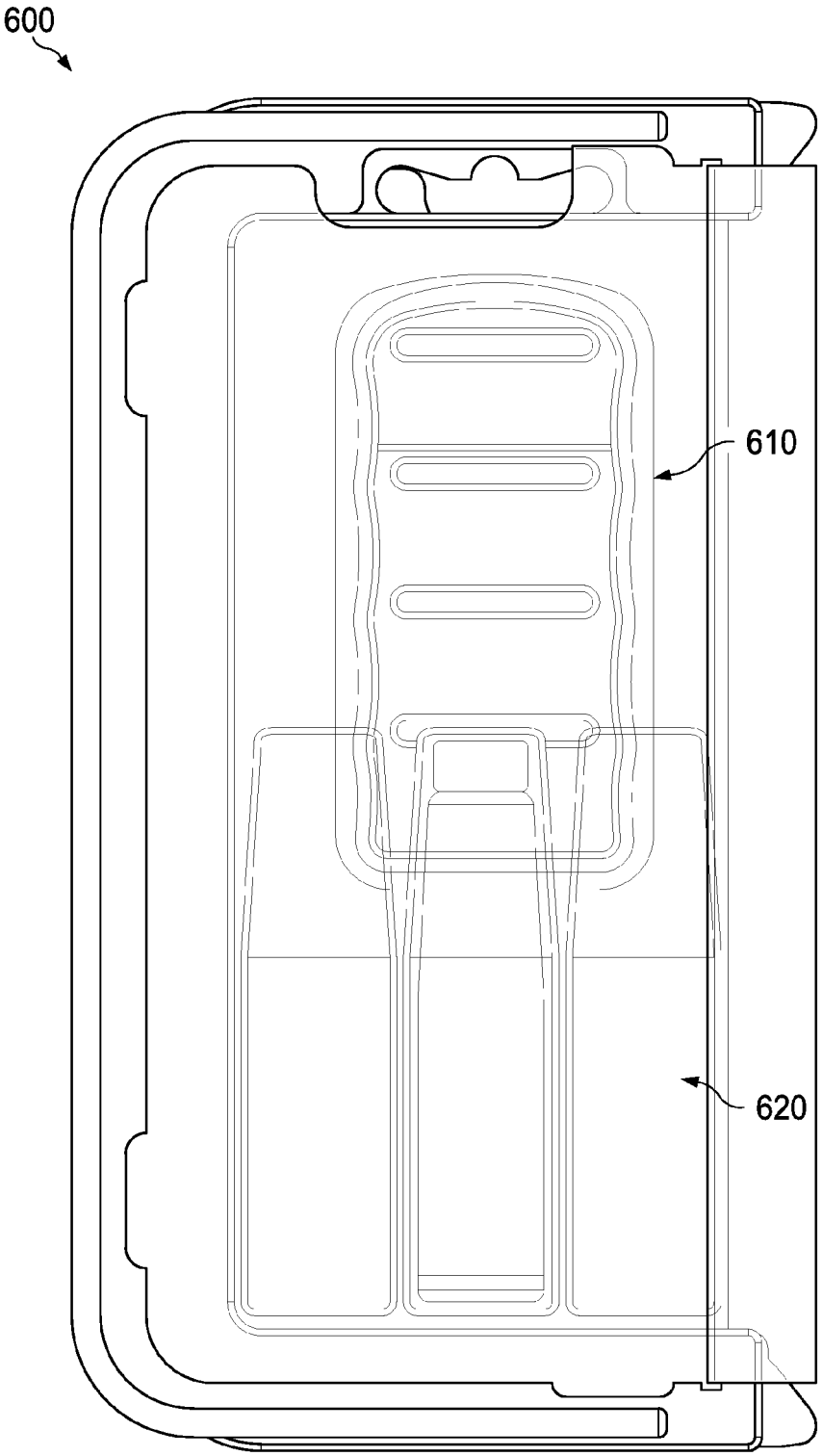
FIG. 11 is a perspective view of a package including replaceable razor cartridges and replaceable fluid reservoirs according to the present invention.

The liquid dispensing razor according to the present invention includes consumable cartridges that need to be replaced after a number of uses as a result of the blades becoming dull, the dispensing member becoming clogged or both. However, the liquid dispensing razor also includes fluid reservoirs that need to be replaced periodically. Although the disposable cartridges and replaceable fluid reservoirs can be packaged separately, they can also be packaged together and made available to consumers in a single package. For instance, replaceable cartridges 610 and replaceable fluid reservoirs 620 can be packaged together in a blister pack package 600 as illustrated in FIG. 11. The number of replaceable cartridges and replaceable fluid reservoirs per package can be the same or different. However, not to be bound by theory, the replaceable fluid reservoirs may contain a volume of fluid that correlates to the number of shaves per razor cartridge so that the consumer replaces the razor cartridge at the same time the fluid reservoir is replaced.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet shaving razor for dispensing a fluid during shaving, the razor comprising:

(a) a handle having a length that extends from a proximal end to a distal end, the handle comprising:

1) a reservoir for housing a fluid disposed within the handle, 2) a connector port disposed at the proximal end of the handle, the connector port comprising a connector port supply end opening and a connector port discharge end opening with a connector port flowpath therebetween, the connector port flowpath converging from the connector port supply end opening to the connector port discharge end opening, wherein the cross-section of the connector port flowpath decreases from the connector port supply end opening to the connector port discharge end opening, and 3) a manually-actuated pump located along the length of the handle, between the reservoir and the connector port, the manually actuated pump includes a first end connected to the reservoir and a second end connected to the connector port supply end opening, wherein the manually-actuated pump is in fluid communication with the reservoir and the connector port; and (b) a razor cartridge comprising:

1) a housing having a top portion, a bottom portion, a front surface and a rear surface, 2) a cartridge connecting structure attached to the rear surface of the housing, wherein the cartridge connecting structure engages the proximal end of the handle, 3) at least one blade positioned between the top portion and the bottom portion, 4) at least one aperture located between the top portion and the bottom portion that extend from the rear surface to the front surface, and 5) a fluid dispensing member joined to the cartridge connecting structure, the fluid dispensing member having at least one dispensing member flowpath with a dispensing member supply end opening and a dispensing member discharge end opening, the dispensing member discharge end opening is in fluid communication with the at least one aperture in the housing, wherein the dispensing member flowpath converges from the dispensing member supply end opening to the dispensing member discharge end opening such that the cross-section of the dispensing member flowpath decreases from the dispensing member supply end opening to the dispensing member discharge end opening, wherein actuation of the pump displaces the fluid from the reservoir through the pump, the connector port, the dispensing member and at least one aperture to the front surface of the housing.

2. The wet shaving razor according to claim 1 wherein the cartridge connecting structure is pivotally attached to the rear surface of the housing.

3. The wet shaving razor according to claim 2 and wherein the dispensing member discharge end opening includes beveled edges that interface with the at least one aperture in the housing to accommodate a pivot range of the housing.

4. The wet shaving razor according to claim 1 wherein the fluid dispensing member is integrally formed with the cartridge connecting structure.

5. The wet shaving razor of claim 1, wherein the reservoir comprises a sachet of fluid.

6. The wet shaving razor of claim 1 wherein the reservoir comprises a collapsible reservoir in a container.

7. The wet shaving razor of claim 1, wherein the razor cartridge further comprises a guard disposed at the front surface, the bottom portion of the housing.

8. The wet shaving razor of claim 1, wherein the razor cartridge further comprises a trough in the front surface of the housing wherein the trough is in fluid communication with the at least one aperture.

9. The wet shaving razor of claim 8, wherein the razor cartridge further comprises microcombs between the trough and the at least one blade, the microcombs comprising channels oriented at an angle to the at least one blade that evenly distribute fluid in front of the at least one blade.

10. The wet shaving razor of claim 1, wherein the razor cartridge is removably attached to the proximal end of the handle.

11. The wet shaving razor according to claim 1 further comprising a lubricating strip disposed on the front surface, top portion of the housing.

12. The wet shaving razor according to claim 11 wherein the lubricating strip contains an electrolyte.

13. The wet shaving razor of claim 1 wherein the connector port comprises an exposed bottom that is translucent.

14. The wet shaving razor of claim 1, wherein the pump comprises a first connector having a first valve in fluid communication with the reservoir, a second connector having a second valve in fluid communication with the connector port supply end opening, and a resilient tube disposed between the first and second connectors, wherein the resilient tube has a neutral position with both valves closed and a second position wherein force is acted upon the resilient tube causing one valve to open and one valve to close causing the fluid to move from the reservoir, through the resilient tube, the connector port, the fluid dispensing member and the at least one aperture to the front surface of the housing.

15. The wet shaving razor of claim 1, wherein the connector port comprises a connector port supply end opening and two connector port discharge end openings with a connector port flowpath therebetween, the connector port flowpath comprising a supply end flowpath of constant cross-section leading to two discharge end flowpaths of converging cross-sections, wherein the cross-sections of the discharge end flowpaths decrease from the supply end flowpath to the two connector port discharge end openings and wherein the dispensing member supply end opening is in fluid communication with the two connector port discharge end openings when the cartridge connecting structure engages the proximal end of the handle.

16. The wet shaving razor according to claim 1 wherein the fluid dispensing member has two dispensing member flowpaths with two dispensing member supply end openings and two dispensing member discharge end openings and at least two apertures are located between the top portion and the bottom portion of the housing that extend from the rear surface to the front surface, the two dispensing member discharge end openings are in fluid communication with the apertures in the housing, wherein the dispensing member flowpaths converge from the dispensing member supply end openings to the dispensing member discharge end openings such that the cross-sections of the dispensing member flowpaths decrease from the two dispensing member supply end openings to the two dispensing member discharge end openings.

17. The wet shaving razor according to claim 16 wherein the dispensing member discharge end openings include beveled edges that interface with the apertures in the housing to accommodate a pivot range of the housing.

* * * * *